United States Patent [19]

Yamada et al.

[11] Patent Number: 5,015,287

[45] Date of Patent: May 14, 1991

[54] STEEL MELTING AND SECONDARY-REFINING METHOD

[75] Inventors: Katsuhiko Yamada; Norio Egusa, both of Hyogo, Japan

[73] Assignee: Sumitomo Electric Industries, Ltd., Osaka, Japan

[21] Appl. No.: 384,485

[22] Filed: Jul. 25, 1989

[30] Foreign Application Priority Data

Jul. 25, 1988 [JP] Japan ..... 63-186388

[51] Int. Cl.[5] ..... C21B 11/10

[52] U.S. Cl. ..... 75/10.17; 75/382

[58] Field of Search ..... 75/49, 46, 10.64, 10.17, 75/382; 266/208, 212

[56] References Cited

U.S. PATENT DOCUMENTS 4,094,495 6/1978 Kutscher et al. ..... 266/208
4,615,511 10/1986 Sherwood ..... 266/208
4,696,458 9/1987 Royzman ..... 75/49

FOREIGN PATENT DOCUMENTS 57-192214 5/1981 Japan .
6173817 9/1984 Japan .

*Primary Examiner*—Melvyn J. Andrews
*Attorney, Agent, or Firm*—Cushman, Darby & Cushman

[57] ABSTRACT

A steel melting and secondary-refining method comprising the steps of: melting steel manufacture raw materials while the molten steel is subjected to oxidation and decarburization so that the oxidation and decarburization are substantially completed before melt-down; after melt-down, heating the molten steel to a temperature above a liquidus line temperature and below 50° C. in temperature increment from the liquidus line temperature, and thereafter tapping the molten steel into a primary ladle; teeming the molten steel from the primary ladle into a secondary refining furnace; allowing the molten steel to be effluent into a secondary ladle at a lower portion of the secondary refining furnace while the temperature of the molten steel is raised; and continuously performing gas bubbling in the secondary ladle in a vacuum under existence of slag simultaneously with the effluence of the molten steel into the secondary ladle.

7 Claims, 4 Drawing Sheets

$$\log Lp \left( = \frac{(\%P)}{[\%P]} \right) = \frac{22350}{T} - 16.0 + 0.08\,(\%CaO) + 2.5 \log (\%T.Fe) \quad \text{----------} \quad (1)$$

STEEL MELTING AND SECONDARY-REFINING METHOD

BACKGROUND OF THE INVENTION

The present invention relates to a steel melting and secondary-refining method in which the steel is melted in an electric furnace and the thus obtained molten steel is refined in ladles.

The following methods have been conventionally utilized for refining molten steel.

① A stream degrassing process (cited from "Progress of Steel Vacuum-degassing Method", THE IRON AND STEEL INSTITUTE OF JAPAN) (see FIG. 1); After melting, oxidation, decarburization, and deoxidation have been performed in an electric furnace, stream vacuum-degassing is performed mainly in a process of transferring molten steel from a ladle to another one. The method has no special refining function other than degassing.

In this method, the electric furnace has poor productivity, high running cost of electric power or the like, and low refining ability.

② An ASEA-SKF method (cited from ASEA Journal, No. 6-7, 39) (see FIG. 2): After melting, oxidation, decarburization, temperature rising, and pre-deoxidation have been performed in an electric furnace, vacuum degassing, induction stirring, and reheating by electric arcs are performed in a refining ladle.

Since a pre-deoxidation process is performed in the electric furnace, high productivity is not obtained by the electric furnace. Further, since dephosphorization is performed by repetition of slag-making and slapping-off processes in the electric furnace, the dephosphorization affects the refining level, refining cost, and electric furnace productivity. In secondary refining, the efficiency of temperature rising is remarkably poor because reheating is performed by arcs, and the productivity is low. Further, the cost of elecric power as well as the cost of subsidiary materials (electrodes and refractories) are high.

③ An LF (Ladle Furnace) method (cited from "Iron and Steel Making Method", THE IRON AND STEEL INSTITUTE OF JAPAN) (see FIG. 3): After melting, oxidation, decarburization, temperature rising, pre-deoxidation have been performed in an electric furnace, reduction refining and reheating are performed in a refining ladle.

This method is equivalent to the ASEA-SKF method from which the vacuum equipment is removed. Therefore, similarly to the ASEA-SKF method, the method has low productivity and high cost of electric power as well as in cost of subsidiary materials. Moreover, in the method, no degassing function exists, and dephosphorizing ability is very low.

④ A vacuum-degassing and bubbling method under existence of slag (cited from Japanese Patent Unexamined Publication Nos. 192214/82 and 73817/86) (see FIG. 4): After melting, oxidation, decarburization, temperature rising, and pre-deoxidation have been performed in an electric furnace, reducing slag is added into a refining ladle, and stirring and vacuum treatment are simultaneously performed under an inert gas such as an Ar gas or the like.

The effects of deoxidation, inclusion-removal, degassing, and the like are remarkable and the reaction speed is very high, so that reheating is not required and it is possible to apply this method to continuous casting.

However, the productivity of an electric furnace is not high, similar to the other methods. Further, dephosphorizing ability is not satisfactory since molten steel is tapped after oxidation and deoxidation at a high temperature.

The problems in the conventional melting and refining techniques as described above are summarized as follows.

① The ability of melting equipment (mainly, an electric furnace) is not exhibited at its maximum. This is because in the conventional technique treatments such as oxidation, decarburization, temperature rising, slagging-off, pre-deoxidation, and the like are performed after melt-down; and thereafter molten steel is tapped.

② The dephosphorizing ability is low. Therefore, it is necessary to perform slag-making and slagging-off process once or more after melt-down. That is, in the conventional technique, molten steel must be tapped at high temperature because the temperature falling is remarkable in secondary refining after the molten-steel is tapped. This is because as the temperature of molten steel rises, the equilibrium distribution coefficient of phosphorus (LP) to slag and molten steel is reduced along the curve in FIG. 5 in accordance with the equation (1) in the same figure.

③ The refining cost in the electric furnace step and the secondary refining step after melt-down is extremely high. In the conventional technique, (a) the temperature rising by electric arcs in the electric furnace and secondary refining furnace is low in energy efficiency (about 25%). Therefore, the treatment time is long and the consumption of electrode rods, refractories and the like is large, so that the refining cost is high. Further, (b) the process of oxidation and decarburization→dephosphorization (slag making→slapping off)→temperature rising→pre-deoxidation→tapping of molten-steel→secondary refining (slag making →deoxidation→desulfurization→degassing→removing inclusion→temperature rising) is progressed stepwise and serially with respect to the whole quantity of molten steel. Therefore, it takes a long time from melting down to the end of refining, and the various costs becomes relatively high.

SUMMARY OF THE INVENTION

An object of the present invention is to provide a method of melting and secondary-refining steel in which the above problems have been solved. The method of this invention comprises the steps of: melting steel manufacture raw materials while molten steel is subject to oxidation and decarburization so that the oxidation and decarbonization are substantially completed before the molten steel is melted down; tapping the molten steel after melt down into a primary ladle after heating the molten steel to a temperature higher than a liquidus line temperature within a temperature increment of 50° C. from the liquidus line temperature; teeming the molten steel from the primary ladle into a secondary refining furnace in which the molten steel is effluent into a secondary ladle at a lower portion of the secondary refining furnace while the temperature of the molten steel is being raised in an induction heating unit of the secondary refining furnace; and continuously performing gas bubbling in the secondary ladle in a vacuum under existence of slag simultaneously with effluence of the molten steel into the secondary ladle.

DETAILED DESCRIPTION OF THE INVENTION

A preferred embodiment of this invention will be described with reference to the accompanying drawings.

Figure 6:
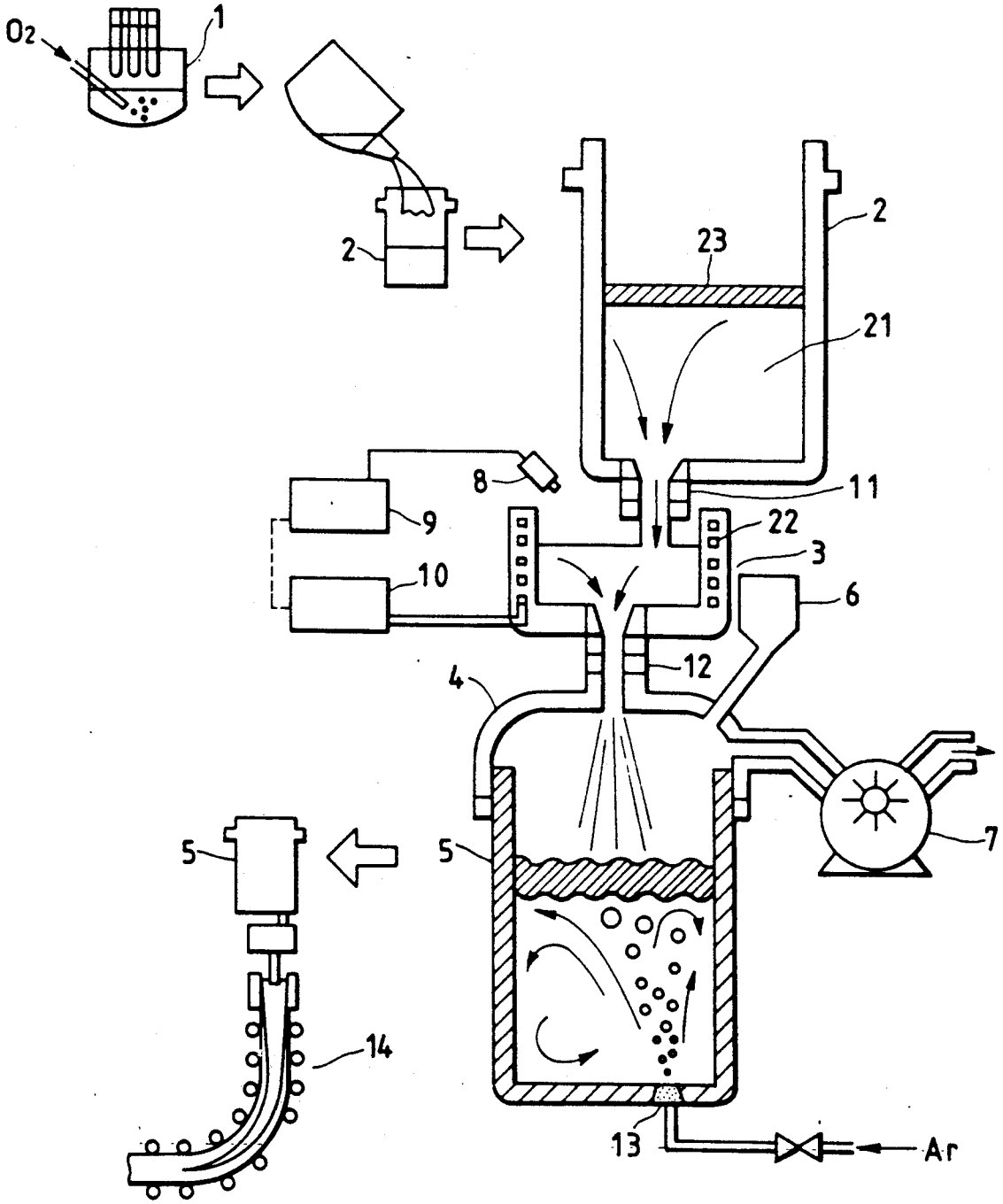
FIG. 6 is a schematic diagram for an embodiment of the steel melting and secondary-refining method according to the present invention.

FIG. 6 is a diagram for an embodiment of the steel melting and secondary-refining method according to the present invention.

The embodiment of the method according to the present invention will be described in detail hereunder.

① First, oxygen is sucked and lime is fed into an electric furnace 1 while steel manufacture raw materials are being melted in the electric furnace 1, thereby conducting the treatment of oxidation and decarburization. Thus, a dephosphorizing reaction is progressed.

② After melt-down, the temperature of the molten steel is raised to a predetermined temperature higher than a liquidus line temperature and below 50° C. in temperature increments from the liquidus line temperature. The above treatment has been completed before the temperature reaches the predetermined temperature. When the temperature reaches the predetermined value, the molten steel is tapped rapidly into a primary ladle 2 together with basic slag. At this time, the greater part of phosphorus has been absorded by the basic slag.

③ The foregoing low-temperature molten steel 21 is subject to temperature rising, deoxidation, desulfurization, degassing, and removal of non-metal inclusion in a refining furnace 3 while it is teemed into the refining furnace 3.

At this time, a slag 23 having phosphorus of high concentration in the primary ladle 2 is prevented from being teemed into the refining furnace 3 by a gate nozzle 11 at the bottom of the primary ladle, and is discharged outside the system.

The refining furnace 3 comprises an upper induction heating unit 22, a vacuum cover 4 airtightly joined to the induction heating unit 22, and a secondary ladle 5 detachably airtightly coupled with the vacuum cover 4 and a vacuum air-discharge system 7.

④ While the low-temperature molten steel 21 in the primary ladle 2 is teemed into the induction heating unit 22 of the refining furnace 3 so as to be induction-heated therein, the molten steel 21 is discharged from a bottom gate nozzle 12 into the secondary ladle 5 through the vacuum cover 4. The teeming, heating, and discharging are performed parallelly and substantially simultaneously.

⑤ The secondary ladle 5 is airtightly configured. Parallelly to the teeming of the molten steel into the secondary ladle 5, an Ar gas is blown into the secondary ladle 5 through a plug nozzle 13 at the bottom of the secondary ladle 5 to thereby perform gas bubbling treatment.

At this time, in parallel to the teeming of the molten steel, the air in the upper space of the secondary ladle 5 is discharged by the vacuum air-discharge system 7 provided in the vacuum cover 4 so that low pressure is kept during refining.

⑥ Slag making material, a deoxidation agent, an alloy and the like, which are required for refining, are suitably charged into the secondary ladle 5 through a vacuum hatch 6.

⑦ Upon initiation of effluence of the molten steel into the secondary ladle 5, pressure reduction is performed. Then, the slag making material is melted and at the same time gas bubbling is performed.

The above treatment is performed under the conditions that the inert gas blowing pressure and the vacuum air-discharge valve are adjusted as follows, for example, as shown in Japanese Patent Unexamined Publication No. 73817/86:

(i) FeO content in slag: $\leqq 5\%$ (ii) Atmospheric pressure: 30 ~ 150 Torr (iii) Gas hold up (boiling height ratio of gas bubbling):

$$\frac{\Delta H}{H} = 0.1 \sim 0.5$$

⑧ Upon completion of effluence of the molten steel into the secondary ladle 5, refining is stopped within 3 minutes and the molten steel is immediately supplied to a continuous casting system 14.

In the method according to the present invention, the temperature control of the molten steel is performed in such a manner that the temperature of the molten steel is continuously measured by means of a radiation pyrometer 8 provided above the induction heating unit 22 of the refining furnace 3, the measurement value is operated by an arithmetic unit 9, and the resultant value is fed back to an induction heating power source 10.

If a deoxidation agent is suitably added to the molten steel in the induction heating unit of the refining furnace 3, the refining in the following step is easily stabilized.

In the steel melting and secondary-refining method according to the present invention: 1 The reason why oxidation and decarburization processes are performed in the electric furnace while a steel manufacture raw materials are being melted, is to make it possible to tap molten steel rapidly after meltdown.

② In order to suitably perform the next refining and casting, the steel tapping temperature (the molten-steel temperature in the furnace) is generally selected to be a value higher than a liquidus line temperature in a range of 100°±30° C. from the liquidus line temperature which is generally determined depending on the product components. The steel tapping temperature higher than a liquidus temperature in a range not larger than 50° C. from the liquidus line temperature is not conventionally used because the operation thereafter cannot be carried out.

Figure 1:
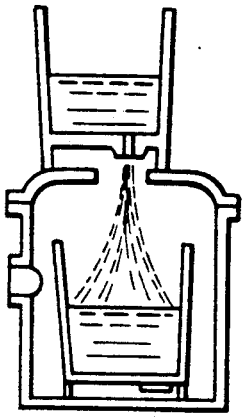
FIG. 1 (PRIOR ART)
FIG. 1 is a schematic diagram for a conventional stream degassing process.
Figure 2:
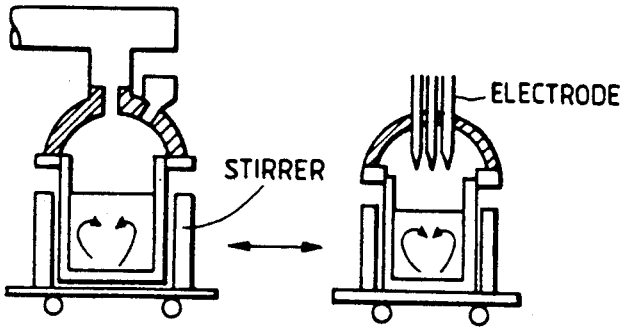
FIG. 2 (PRIOR ART)
FIG. 2 is a schematic diagram for a conventional ASEA-SKF method.
Figure 3:
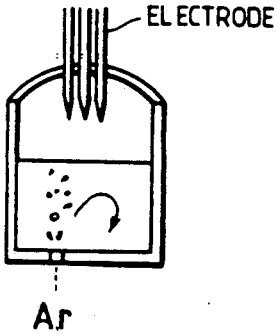
FIG. 3 (PRIOR ART)
FIG. 3 is a schematic diagram for a conventional LF method.
Figure 4:
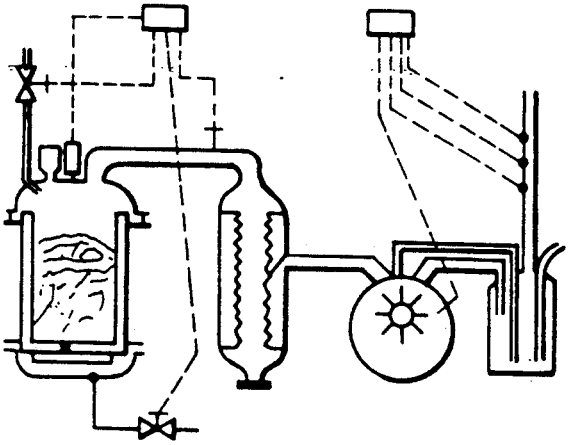
FIG. 4 (PRIOR ART)
FIG. 4 is a schematic diagram for a conventional vacuum-degassing and bubbling method under existence of slag.
Figure 5:
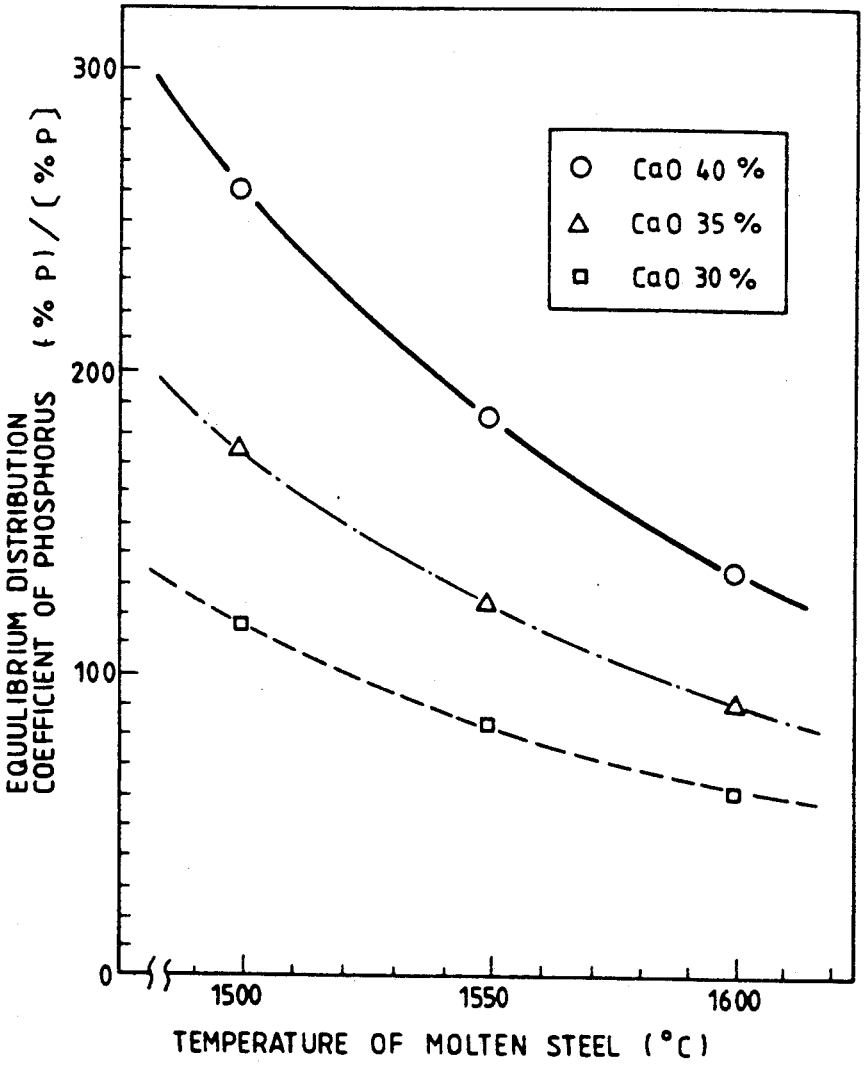
FIG. 5 is a diagram showing the relation between the temperature and equilibrium distribution coefficient of phosphorus.

In such a high temperature, however, the equilibrium distribution coefficient to phosphorus slag and molten steel is small as shown in FIG. 5 so as to be extremely disadvantageous in dephosphorization and rephosphorization. Therefore, slag making and slagging off processes are generally performed once or more immediately after melt-down, thereby discharging phosphorus outside the system.

In the low-temperature steel tapping (above the liquidus line temperature and below 50° C. in temperature increment from the liquidus line temperature) according to the present invention, the equilibrium distribution coefficient of phosphorous is large as shown in FIG. 5. Further, the slag is tapped into the primary ladle together with molten steel, and the temperature of the molten steel, particularly, the temperature of the slag, is further lowered, so that the greater part of the phosphorus component has remained in the slag.

In the teeming of the molten steel in the next step from the primary ladle to the refining furnace, the slag including phosphorus of high concentration is prevented from being teemed by slide gate provided at a bottom of the primary ladle and discharged outside the system so that rephosphorization is never generated. Accordingly, a high degree of dephosphorization can be performed extremely easily with a minimum quantity of slag.

The foregoing low steel-tapping temperature is the minimum value of temperature rising for avoiding a trouble of coagulation of molten steel in the primary ladle.

As described above, the molten steel is tapped from the electric furnace after the electric furnace is operated only in a time required for melting a raw material and for performing the minimum temperature rising, so that the productivity in the electric furnace is considerably large and various costs of the electric furnace are exceedingly reduced.

③ In parallel to the teeming of the low-temperature molten steel into the induction heating unit of the refining furnace, the molten steel teemed into the induction heating unit is subject to required temperature rising by induction heating. In this case, the induction heating is remarkably advantageous in energy efficiency in comparison with reheating by electric arcs.

However, the induction heating is not generally used. This is because, in a large-sized equipment, there are difficulties in electrical and mechanical design, and efficiency is poor.

In order to overcome the foregoing fundamental weak points in the induction heating furnace, according to the present invention, the flow-in and heat-flow-out of molten steel are performed parallelly simultaneously with each other. Further, the induction heating is advantageous in that the loss of refractories can be reduced because no slag is required unlike the case of arc heating requiring slag, in that no electrode rod is required, and in that the temperatures rising can be performed at a low cost.

④ In the secondary ladle, in parallel to the effluence of the molten steel from the induction heating unit, the deoxidation, degassing, desulfurization, and removal of non-metal inclusion are progressed as disclosed in Japanese Patent Unexamined Publication No. 73817/86. In this case, the operation is not batch treatment for the whole quantity of molten steel, but continuous and integrative treatment.

Thus, the fact that a series of refining work is performed continuously, integratively and parallelly during transfer of molten steel from the primary ladle to the secondary ladle, has an extremely important meaning upon the cost of equipment, the cost of operation, and the like.

⑤ The capacity of the induction heating unit may be 1/10~1/30 of that of the primary ladle. If the capacity is larger than the above value, the cost of equipment as well as the cost of refractories are wasteful. If the capacity is smaller than the above value, on the contrary, the induction coil is too small to obtain a predetermined heating ability.

Similarly, the output of the vacuum air-discharge appratus may be ⅓ or less of the output required in a case of a prefect batch system.

⑥ Since refining in the secondary ladle is started from a state where the quantity of molten steel is still small, no bumping is caused even in gas bubbling of non-deoxidated molten steel in a vacuum and the refining is secure. This is an exceedingly important effect.

Further, as the quantity of molten steel is increased, the reaction surface between slag and refractories rises, and the refractory in the secondary ladle does not cause local melting loss unlike the conventional secondary-refining furnace, but causes melting loss uniformly all over the surface of the refractory. This is an excellent effect on the life of the ladle refractory.

Since it takes 10 to 20 minutes from the start of steel tapping to the completion of refining by the method according to the present invention as described above, the losses in heat and in refractories are less and the quantity of heat required for temperature rising is less. Therefore, the refining cost is remarkably reduced. With respect to the cost of equipment, although it is necessary to provide the induction heating unit in addition to the inexpensive equipment disclosed in Japanese Patent Post-examination Publication No. 73817/86, in the case of an electric furnace of 30 ton, the furnace capacity of 2 ton of an induction heating unit in a refining furnace will suffice and power of source of 1,000~3,000 kW will suffice, so that the cost of equipment is low.

EXAMPLE

Figure 7:
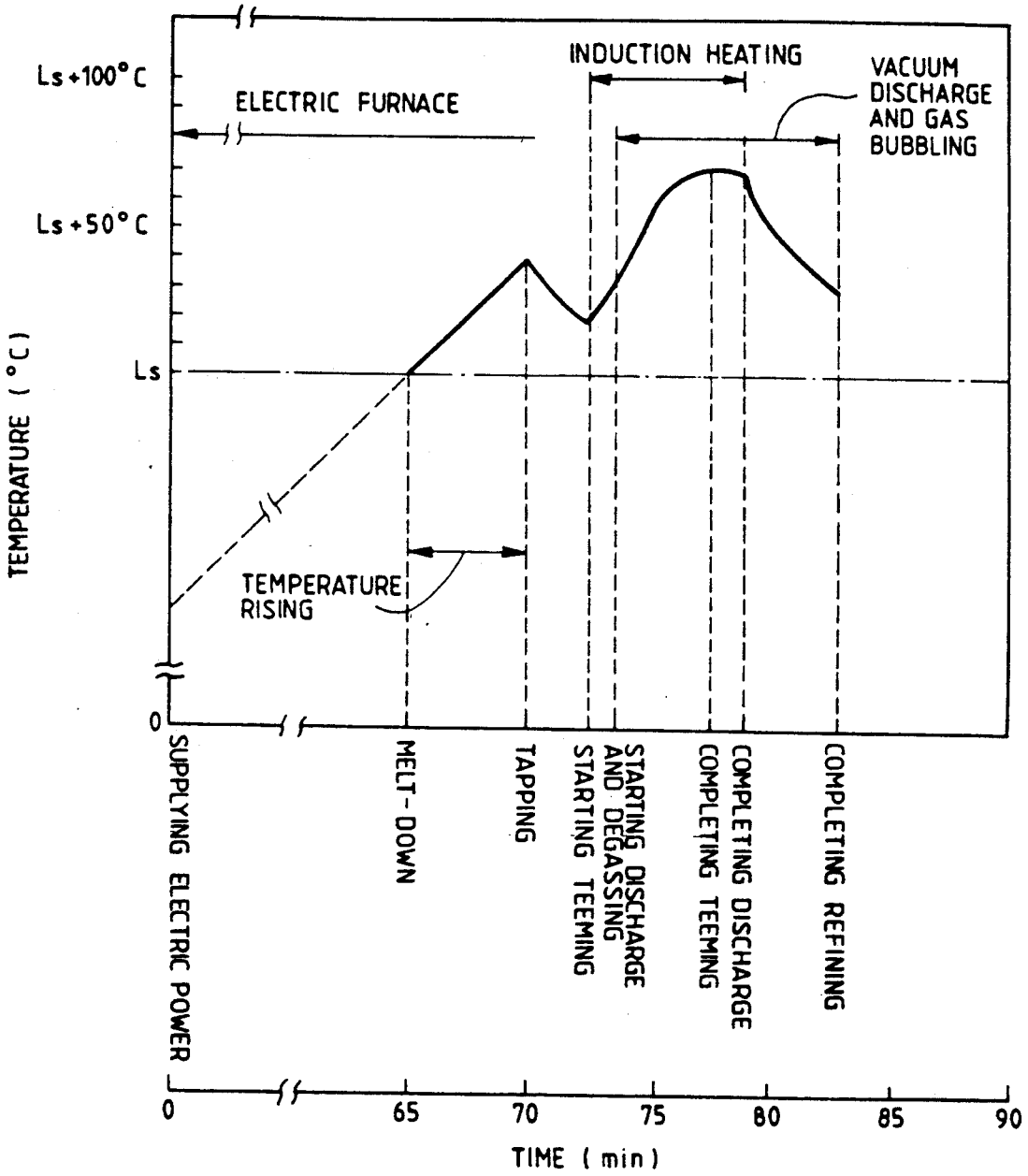
FIG. 7 is a diagram showing the change in molten steel temperature versus time elapsed in the embodiment of this invention.

FIG. 7 shows changes in temperature of molten steel with time elapse in the case where 30 ton of molten steel was produced by using the method according to the present invention.

The time required from the power supply to an electric furnace to the tapping of molten steel (tap to tap time) was considerably reduced although the time depends on the capacity of a transformer. The used electric power was about 350 kWH/ton or less, so that the productivity in the electric furnace could be improved and the running cost, such as electric power cost etc. could be remarkably reduced.

Further, the phosphorus in the molten steel could be reduced to about 0.010% or less with a slag making material of a half quantity of the general cases, and 0.002% could be realized depending on the quantity of the slag making material.

It took 10 to 20 minutes from the start of tapping of molten steel to the completion of refining. The desired molten steel temperature after completion of refining could be accomplished by the quantity of electric power of 20~40 kWH/ton which was applied through induction heating during the above period of time.

Further, since continuous and integral degassing treatment was performed in the molten steel discharging process, it was possible to attain the oxygen content of 15 ppm or less, the nitrogen content of 40 ppm or less, the sulfur content of 0.010% or less, and the cleanliness of 0.008% or less.

As described above, the steel melting and secondary-refining method according to the present invention has effects listed as follows:

① The period of one cycle in an electric furnace can be reduced by 10~30 minutes in comparison with the conventional method because molten steel is tapped only after melting and minimum temperature rising;

② Since the greater part of phosphorus is absorbed in slag through low-temperature molten steel tapping and discharged outside the system as a primary ladle residue, the dephosphorization can be easily performed at a low cost;

③ Since the energy efficiency is large and the comsumption of refractories and electrode rods is small the total refining cost is extremely low;

④ Since only a primary ladle and an induction heating furnace are additionally provided in the inexpensive equipment of the prior art apparatus, and heating and refining are continuously and integratively performed in the induction heating furnace and vacuum treatment equipment, a small equipment ability will suffices so as to make the cost of equipment low; and ⑤ Because of high degree of dephosphorization is performed in addition to the excellent refining effect of the prior art apparatus, phosphorus content of 0.002% can be realized.

What is claimed is:

1. A method of melting and secondary-refining steel, said method comprising the steps of:

melting steel materials to produce molten steel and substantially simultaneously subjecting the molten steel to oxidation and decarburization, thereby progressing a dephosphorizing reaction;

tapping the molten steel into a primary ladle after a temperature of the molten steel has been raised incrementally to a value between a liquidus line temperature and 50° C. above the liquidus line temperature, thereby effectively dephosphorizing the steel;

teeming the molten steel into a refining furnace from the primary ladle;

controlling the temperature of the molten steel in the refining furnace utilizing a radiation sensor and an arithmetic unit to produce controlling signals along with an induction heater that heats the steel per the controlling signals, the temperature of the refining furnace being effectively regulated;

allowing the molten steel to flow into a secondary ladle at a lower portion of the secondary refining furnace while the temperture of the molten steel is raised by the induction heater; and continuously bubbling argon gas into the secondary ladle, the secondary ladle having a vacuum within and slag existing within the secondary ladle, said bubbling step occurring concurrently with the flow of molten steel into the secondary ladle;

wherein said teeming, controlling, allowing and bubbling steps are continuously and simultaneously performed.

2. A method as claimed in claim 1, wherein said bubbling step is performed under atmospheric pressure in the secondary ladel in a range from 30 to 150 torr and a boiling height ratio $\Delta H/H$ in a range from 0.1 to 0.5, where H is a stationary depth of the molten steel and $\Delta H$ is a surface raising height due to boiling.

3. A method as claimed in claim 2, further comprising the step of discharging residual slag having phosphours of high concentration in the primary ladle out of a system without teeming the residual slag into the secondary refining furnace at the time of completion of the tapping of the molten steel into the secondary refining furnace, said molten steel having been dephosphorized by the oxidation-refining in the primary ladle.

4. A method as claimed in claim 1, wherein stoppages occurs within three minutes after completion of the flow of the molten steel into the secondary ladle.

5. A method as claimed in claim 1, further comprising the step of subjecting the molten steel to continuous casting immediately after stoppage of flow to the secondary ladle.

6. A method as claimed in claim 1, wherein the molten steel is subjected to a temperture increase, deoxidation, desulfurization, degassing and removal of nonmetal inclusion while the molten steel flows from the primary ladle into a secondary refining furnace.

7. A method as claimed in claim 1, further comprising the step of adding basic slag to the primary ladle while the molten steel is tapped into the primary ladle.

* * * * *